US011389677B2

(12) United States Patent
Cayssials et al.

(10) Patent No.: US 11,389,677 B2
(45) Date of Patent: Jul. 19, 2022

(54) FIRE-FIGHTING SYSTEM FOR AN AIRCRAFT, HAVING A DOUBLE-CHAMBER RESERVOIR

(71) Applicant: Airbus Operations SAS, Toulouse (FR)

(72) Inventors: Julien Cayssials, Gagnac sur Garonne (FR); Arnaud Guichot, Blagnac (FR)

(73) Assignee: AIRBUS OPERATIONS SAS, Toulouse (FR)

( * ) Notice: Subject to any disclaimer, the term of this patent is extended or adjusted under 35 U.S.C. 154(b) by 40 days.

(21) Appl. No.: 16/842,190

(22) Filed: Apr. 7, 2020

(65) Prior Publication Data

US 2020/0324154 A1 Oct. 15, 2020

(30) Foreign Application Priority Data

Apr. 12, 2019 (FR) ..... 1903914

(51) Int. Cl.
*A62C 3/08* (2006.01)
*A62C 35/13* (2006.01)
*A62C 35/08* (2006.01)

(52) U.S. Cl.
CPC ..... *A62C 3/08* (2013.01); *A62C 35/13* (2013.01); *A62C 35/08* (2013.01)

(58) Field of Classification Search
CPC ..... A62C 3/08; A62C 35/13; A62C 35/08
USPC ..... 169/9, 20, 56, 60, 61, 62, 71, 74, 76
See application file for complete search history.

(56) References Cited

U.S. PATENT DOCUMENTS 1,968,825 A * 8/1934 Goodall ..... A62C 13/003 169/76

* cited by examiner

*Primary Examiner* — Christopher S Kim
(74) *Attorney, Agent, or Firm* — Greer, Burns & Crain, Ltd.

(57) ABSTRACT

A fire-fighting system for an aircraft, the fire-fighting system having a reservoir having an exterior envelope which delimits an interior volume of the reservoir and an interior wall which extends inside the exterior envelope and separates the interior volume into a first chamber and a second chamber which are separate from one another and are each filled with an extinguishing fluid. A network of pipes, and a valve system are provided which are arranged so as to allow, in succession, the extinguishing fluid to flow from the first chamber to the network of pipes, and then the extinguishing fluid to flow from the second chamber to the network of pipes. Such a fire-fighting system allows simpler installation in the aircraft, the fitting of a single network of pipes and hence a saving in terms of weight and volume.

3 Claims, 1 Drawing Sheet

FIRE-FIGHTING SYSTEM FOR AN AIRCRAFT, HAVING A DOUBLE-CHAMBER RESERVOIR

CROSS-REFERENCES TO RELATED APPLICATIONS

This application claims the benefit of the French patent application No. 1903914 filed on Apr. 12, 2019, the entire disclosures of which are incorporated herein by way of reference.

FIELD OF THE INVENTION

The present invention relates to a fire-fighting system for an aircraft, the fire-fighting system having a reservoir with a double chamber, and to an aircraft having at least one such fire-fighting system.

BACKGROUND OF THE INVENTION

An aircraft conventionally has at least one nacelle inside which an engine, for example of the turbojet type, is disposed. The nacelle and the engine are fixed to the structure of the aircraft by means of a pylon fixed beneath the wing of the aircraft.

In order to avoid the structure of the aircraft becoming damaged when the engine catches fire, the aircraft is fitted with a fire-fighting system.

The fire-fighting system has two reservoirs which are installed in the pylon and which contain an extinguishing fluid. For each reservoir, the fire-fighting system also has a network of pipes which extends between the reservoir and the engine.

Each reservoir is closed by a disc and is fitted with an explosive cartridge which destroys the disc when it is activated. This destruction allows the extinguishing fluid to be released and then to flow into the pipes.

Although such a fire-fighting system gives good results, the two-reservoir architecture is bulky.

Indeed, the diameter of the engines is tending to increase and this then leads to the nacelle being brought closer to the wing and correspondingly reduces the space available in the pylon for accommodating the two reservoirs and the two networks of pipes.

It is therefore desirable to find a fire-fighting system having a novel architecture which allows space to be saved in the pylon.

SUMMARY OF THE INVENTION

An object of the present invention is to propose a fire-fighting system having a two-chamber reservoir thus allowing space to be saved, resulting in better integration into the pylon of an aircraft.

To that end, a fire-fighting system for an aircraft is proposed, the fire-fighting system having:

- a reservoir having an exterior envelope which delimits an interior volume of the reservoir and an interior wall which extends inside the exterior envelope and separates the interior volume into a first chamber and a second chamber which are separate from one another and are each filled with an extinguishing fluid,
- a network of pipes, and
- a valve system which is arranged so as to allow, in succession, the extinguishing fluid to flow from the first chamber to the network of pipes, and then the extinguishing fluid to flow from the second chamber to the network of pipes.

Such a fire-fighting system allows simpler installation in the aircraft, the fitting of a single network of pipes and hence a saving in terms of weight and volume.

Advantageously, the valve system has:

- a duct which has a first orifice opening into the first chamber, a second orifice opening into the second chamber, and a third orifice opening onto the network of pipes, the duct also having a first seat downstream of the second orifice and a second seat downstream of the first orifice,
- a shut-off member able to move between a first position in which the shut-off member is positioned on the first seat and a second position in which the shut-off member is positioned on the second seat,
- a first disc which shuts off the passage between the first orifice and the third orifice,
- a second disc which shuts off the passage between the second orifice and the shut-off member, and
- for each disc, an opening system intended to destroy the disc when it is activated.

Advantageously, each chamber is fitted with a sensor suitable for monitoring the pressure of the extinguishing fluid in the chamber, and the two sensors are connected to one and the same interface.

The invention also proposes an aircraft having an engine, a pylon which bears the engine, and a fire-fighting system according to one of the preceding variants, wherein the reservoir is fixed in the pylon, and wherein the network of pipes extends between the reservoir and the engine.

BRIEF DESCRIPTION OF THE DRAWINGS

The above-mentioned features of the invention, along with others, will become more clearly apparent on reading the following description of one exemplary embodiment, the description being given with reference to the appended drawings, in which.

DETAILED DESCRIPTION OF THE PREFERRED EMBODIMENTS

Figure 1:
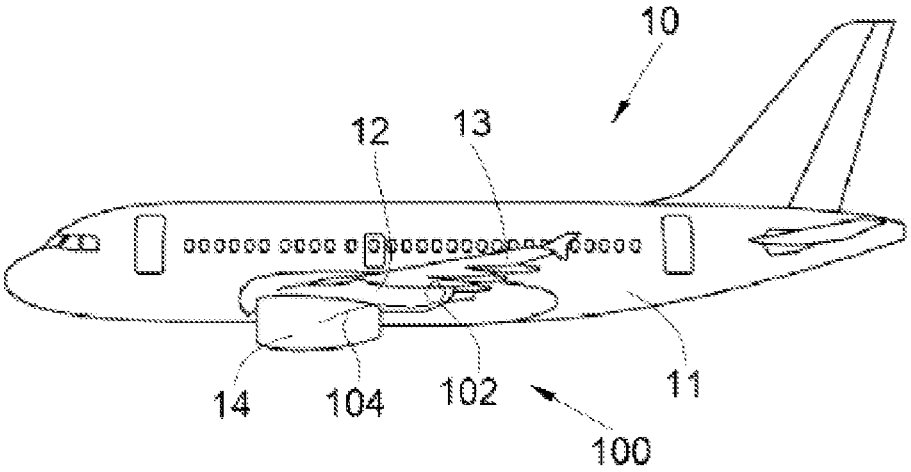
FIG. 1 is a side view of an aircraft according to the invention.

FIG. 1 shows an aircraft 10 which has a fuselage 11 to each side of which is fixed a wing 13 which bears an engine 14 such as a turbofan.

For each engine 14, the aircraft 10 also has a pylon 12 which fixes the engine 14 beneath the wing 13.

Figure 2:
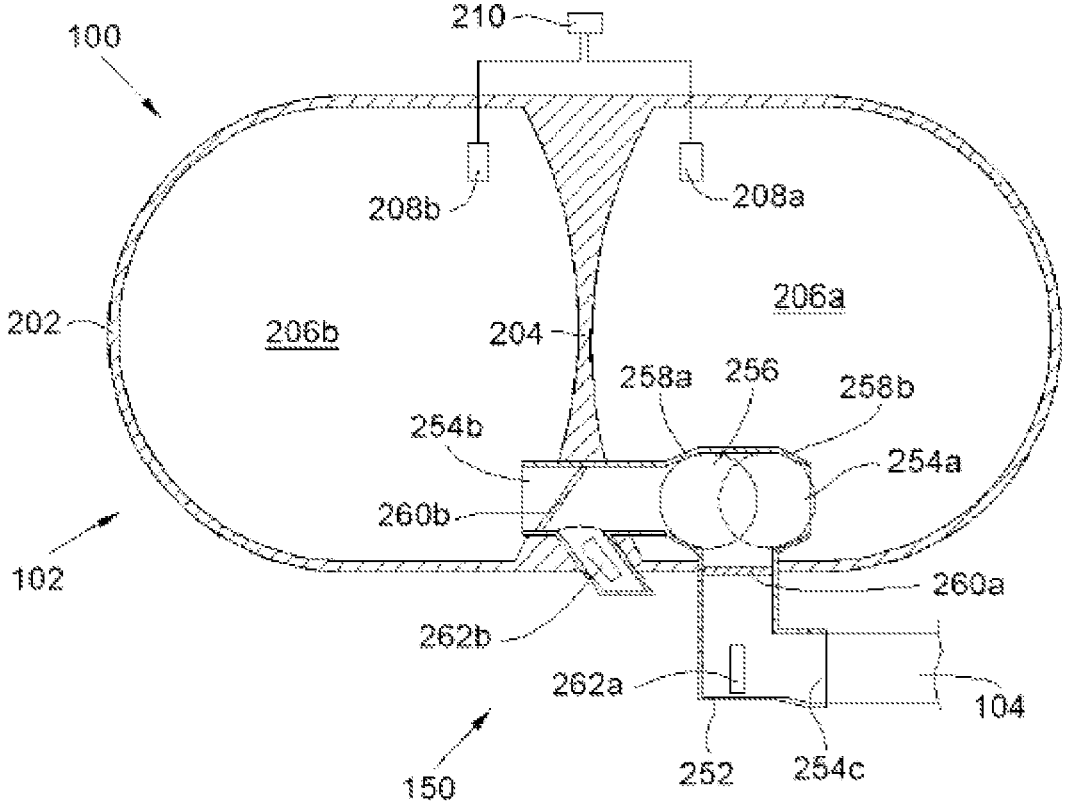
FIG. 2 is a schematic representation in cross-sectional view of a fire-fighting system according to the invention.

For each engine 14, the aircraft 10 has a fire-fighting system 100. FIG. 2 shows the fire-fighting system 100.

The fire-fighting system 100 has a reservoir 102 which is fixed in the pylon 12 and a network of pipes 104 which extends between the reservoir 102 and the engine 14.

The reservoir 102 has an exterior envelope 202 which delimits the interior volume of the reservoir 102 and an interior wall 204 which extends inside the exterior envelope 202 and separates the interior volume of the reservoir 102 into a first chamber **206*a* and a second chamber 206*b*** which are separate from one another.

Each chamber **206*a*-*b*** is filled with an extinguishing fluid.

The fire-fighting system 100 also has a valve system 250 which is arranged so as to allow, in succession, the extinguishing fluid to flow from the first chamber 206*a* to the network of pipes 104, and then the extinguishing fluid to flow from the second chamber 206*b* to the network of pipes 104.

The valve system 250 and the interior wall 204 establish sealing between the two chambers 206*a-b*, meaning that the extinguishing fluid from one chamber 206*a-b* cannot flow to the other chamber 206*b-a*.

Such a fire-fighting system 100 thus allows simpler installation in the aircraft 10, the fitting of a single network of pipes 104 between the reservoir 102 and the engine 14 and hence a single interface between the valve system 250 and the network of pipes 104.

Such an installation also allows compliance with legislation requiring two separate volumes of extinguishing fluid to be present per engine 14.

The valve system 250 has a duct 252 which in this case is T-shaped and which has a first orifice 254*a* which opens into the first chamber 206*a*, a second orifice 254*b* which opens into the second chamber 206*b*, and a third orifice 254*c* which opens onto the network of pipes 104.

In other words, the first orifice 254*a* is in fluidic communication with the first chamber 206*a*, the second orifice 254*b* is in fluidic communication with the second chamber 206*b*, and the third orifice 254*c* is in fluidic communication with the network of pipes 104.

Thus, the first chamber 206*a* is in fluidic communication with the network of pipes 104 via the first orifice 254*a* and the third orifice 254*c*, and the second chamber 206*b* is in fluidic communication with the network of pipes 104 via the second orifice 254*b* and the third orifice 254*c*.

The valve system 250 also has a shut-off member 256 which is able to move between a first position (shown in solid line in FIG. 2) and a second position (shown in dashed line in FIG. 2). In the embodiment of the invention shown in FIG. 2, the shut-off member 256 takes the form of a ball.

In the first position, the shut-off member 256 is positioned on a first seat 258*a* made in the duct 252 downstream of the second orifice 254*b* relative to a flow of extinguishing fluid from the second chamber 206*b* to the third orifice 254*c*. This positioning shuts off the passage between the second orifice 254*b* and the third orifice 254*c* while leaving the passage between the first orifice 254*a* and the third orifice 254*c* clear, thus allowing the extinguishing fluid to flow from the first chamber 206*a* to the network of pipes 104.

In the second position, the shut-off member 256 is positioned on a second seat 258*b* made in the duct 252 downstream of the first orifice 254*a* relative to a flow of extinguishing fluid from the first chamber 206*a* to the third orifice 254*c*. This positioning shuts off the passage between the first orifice 254*a* and the third orifice 254*c* while leaving the passage between the second orifice 254*b* and the third orifice 254*c* clear, thus allowing the extinguishing fluid to flow from the second chamber 206*b* to the network of pipes 104.

The shut-off member 256 and the seats 258*a-b* form a valve.

The valve system 250 also has a first disc 260*a* which shuts off the passage between the first orifice 254*a* and the third orifice 254*c*. In the embodiment of the invention shown in FIG. 2, the first disc 260*a* is disposed between the shut-off member 256 and the third orifice 254*c*, but it could be disposed between the first orifice 254*a* and the shut-off member 256.

The valve system 250 also has a second disc 260*b* which shuts off the passage between the second orifice 254*b* and the shut-off member 256, i.e., the first seat 258*a* in this case.

For each disc 260*a-b*, the valve system 250 has an opening system 262*a-b*, typically an explosive cartridge, which is intended to destroy the disc 260*a-b* when it is activated.

The aircraft 10 conventionally has fire sensors distributed in the engine 14 and connected to a control unit which also controls each opening system 262*a-b*.

The operating principle of the fire-fighting system 100 is then as follows. When the control unit detects a fire in the engine 14, it commands the activation of the opening system 262*a* associated with the first disc 260*a* which opens. Under the pressure of the extinguishing fluid present in the first chamber 206*a*, the shut-off member 256 is pressed against the first seat 258*a* and the extinguishing fluid is then prevented from going to the second chamber 206*b* and flows to the third orifice 254*c* and the network of pipes 104.

If the quantity of extinguishing fluid thus released is not sufficient to put out the fire, the control unit commands the activation of the opening system 262*b* associated with the second disc 260*b* which opens. Under the pressure of the extinguishing fluid present in the second chamber 206*b*, the shut-off member 256 is pressed against the second seat 258*b* and the extinguishing fluid is then prevented from going to the first chamber 206*a* and flows to the third orifice 254*c* and the network of pipes 104.

The pressure in each chamber 206*a-b* is monitored by a suitable sensor 208*a-b* such as a pressure sensor, for example. The architecture of the reservoir 102 allows there to be a single interface 210 for the two sensors 208*a-b*, thus simplifying the architecture. Thus, each chamber 206*a-b* is fitted with a sensor 208*a-b* suitable for monitoring the pressure of the extinguishing fluid in the chamber 206*a-b*, and the two sensors 208*a-b* are connected to the same interface 210 which can then simply be connected to the control unit.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A fire-fighting system for an aircraft, said fire-fighting system having:

a reservoir having an exterior envelope which delimits an interior volume of the reservoir and an interior wall which extends inside the exterior envelope and separates said interior volume into a first chamber and a second chamber which are separate from one another and are each filled with an extinguishing fluid, a network of pipes, and a valve system which is configured so as to allow, in succession, the extinguishing fluid to flow from the first chamber to the network of pipes, and then the extinguishing fluid to flow from the second chamber to the network of pipes, the valve system comprising:

a duct which has a first orifice opening into the first chamber, a second orifice opening into the second chamber, and a third orifice opening onto the network of pipes, said duct also having a first seat downstream of the second orifice and a second seat downstream of the first orifice, a shut-off member configured to move between a first position in which the shut-off member is positioned on the first seat and a second position in which the shut-off member is positioned on the second seat, a first disc which shuts off a passage between the first orifice and the third orifice, a second disc which shuts off the passage between the second orifice and the shut-off member, and for each disc, an opening system configured to destroy said disc when the operating system is activated.

2. The fire-fighting system according to claim 1, wherein each chamber is fitted with a sensor configured to monitor a pressure of the extinguishing fluid in said chamber, and wherein the two sensors are connected to a same interface.

3. An aircraft comprising an engine, a pylon which bears the engine, and a fire-fighting system for an aircraft, said fire-fighting system having:

a reservoir having an exterior envelope which delimits an interior volume of the reservoir and an interior wall which extends inside the exterior envelope and separates said interior volume into a first chamber and a second chamber which are separate from one another and are each filled with an extinguishing fluid, a network of pipes, and a valve system which is configured so as to allow, in succession, the extinguishing fluid to flow from the first chamber to the network of pipes, and then the extinguishing fluid to flow from the second chamber to the network of pipes, the valve system comprising:

a duct which has a first orifice opening into the first chamber, a second orifice opening into the second chamber, and a third orifice opening onto the network of pipes, said duct also having a first seat downstream of the second orifice and a second seat downstream of the first orifice, a shut-off member configured to move between a first position in which the shut-off member is positioned on the first seat and a second position in which the shut-off member is positioned on the second seat, a first disc which shuts off a passage between the first orifice and the third orifice, a second disc which shuts off the passage between the second orifice and the shut-off member, and for each disc, an opening system configured to destroy said disc when the operating system is activated, wherein the reservoir is fixed in the pylon, and wherein the network of pipes extends between said reservoir and the engine.

* * * * *